United States Patent [19]

Simila

[11] Patent Number: 4,638,645

[45] Date of Patent: Jan. 27, 1987

[54] BEVERAGE CONTAINER COOLER

[76] Inventor: Eric J. Simila, 2548 Washington St., Lemon Grove, Calif. 92045

[21] Appl. No.: 783,404

[22] Filed: Oct. 3, 1985

[51] Int. Cl.[4] ..... F25D 3/08

[52] U.S. Cl. ..... 62/457; 62/371; 62/529

[58] Field of Search ..... 62/430, 457, 371, 372, 62/529, 530, 460, 461

[56] References Cited

U.S. PATENT DOCUMENTS

| | | | |
|---|---|---|---|
| 3,302,427 | 2/1967 | Stoner et al. | 62/529 X |
| 3,302,428 | 2/1967 | Stoner et al. | 62/371 X |
| 3,603,106 | 9/1971 | Ryan et al. | 62/457 |
| 3,715,895 | 2/1973 | Devlin | 62/457 |
| 3,807,194 | 4/1974 | Bond | 62/457 |
| 3,995,445 | 12/1976 | Huskins | 62/457 X |
| 4,357,809 | 11/1982 | Held et al. | 62/457 |

*Primary Examiner*—Lloyd L. King

*Attorney, Agent, or Firm*—Brown, Martin, Haller & Meador

[57] ABSTRACT

A beverage container cooler comprises an outer container and an inner container co-axially mounted within the outer container for receiving a single beverage container such as a bererage containing can in a sleeve-like fashion. The spacing between the opposed inner and outer surfaces of the containers comprises a coolant chamber for receiving ice, for example, to keep the beverage in the container cool.

10 Claims, 4 Drawing Figures

BEVERAGE CONTAINER COOLER

BACKGROUND OF THE INVENTION

The present invention relates to coolers for keeping beverages in typical containers such as aluminum cans cool for a lengthened period of time.

Aluminum cans containing beverages such as soft drinks and beer heat up relatively rapidly when removed from a refrigerator or ice box, particularly in hot weather conditions. Thus a beverage which is relatively cold when a person opens a can and starts to drink it can warm up substantially and become quite unpalatable before the drinker finishes the can. Additionally, such cans are relatively unstable unless placed on a flat surface such as a table, so that it is difficult to replace them in a cool box once opened or to place them on the ground when they are drunk out of doors at a picnic, for example. Thus a person has the choice of either finishing up the whole can as soon as it is opened and while it remains relatively cool, or placing it on the ground or in some other relatively unstable place between drinks, where it may be knocked over and will become quite warm over prolonged periods of time.

Foam sleeves for receiving beverage cans are known, which provide insulation between the drinker's fingers and the outer surface of the can and will therefore slow down the warming up process slightly. However the insulating properties of such sleeves are minimal and they do not avoid the risk of the can being tipped or knocked over.

SUMMARY OF THE INVENTION

According to the present invention a beverage container cooler and holder is provided which comprises an outer container, an inner container co-axially mounted within the outer container, the inner container being shaped to receive a predetermined type of beverage container in a sleeve-like fashion, and a coolant chamber defined between the opposed outer and inner faces of the inner and outer container, respectively, for receiving a coolant material such as ice.

Preferably the inner container is shaped to receive an aluminum can of the type containing beer or soft drinks, and the outer container is of corresponding cylindrical shape but larger dimensions so as to leave the necessary gap between the two containers for receiving the coolant material. The cooler may alternatively be designed to receive a single drink containing bottle or a cardboard carton of the type containing fruit juice or milk. The inner container is preferably in the form of a cage of mesh material or of material having openings to expose the drink container to the ice or other coolant material in the coolant chamber.

According to one preferred embodiment of the invention the inner container is removably mounted in the outer chamber and comprises a cylindrical section for projecting into the outer container having a projecting annular flange at its upper end, the outer container having a lip or ledge on which the annular flange rests when the inner container is placed into the outer container. A suitable removable locking cap is preferably provided to lock the inner container in place, the cap having a central opening to allow a beverage container to be placed in the inner container.

The inner container preferably has a series of spaced longitudinal slits around its periphery which communicate the interior of the inner container with the coolant chamber but which are narrow enough to prevent ice cubes or chunks from entering the inner container prior to insertion of a beverage container.

Thus a beverage container can be kept relatively cool over prolonged periods of time, will be held upright by the relatively stable cooler when the beverage is not being consumed, and can be quickly and easily removed from or placed in the container. The beverage can be consumer either with the container still retained in the cooler or by removing it from the cooler to take a drink. The parts of the container can be separated quickly and easily for emptying melted ice and/or cleaning purposes, and for adding new ice to the coolant chamber. The locking cap may be provided with a drain opening for pouring off melted ice when the holder is in use.

DESCRIPTION OF THE PREFERRED EMBODIMENT

Figure 1:
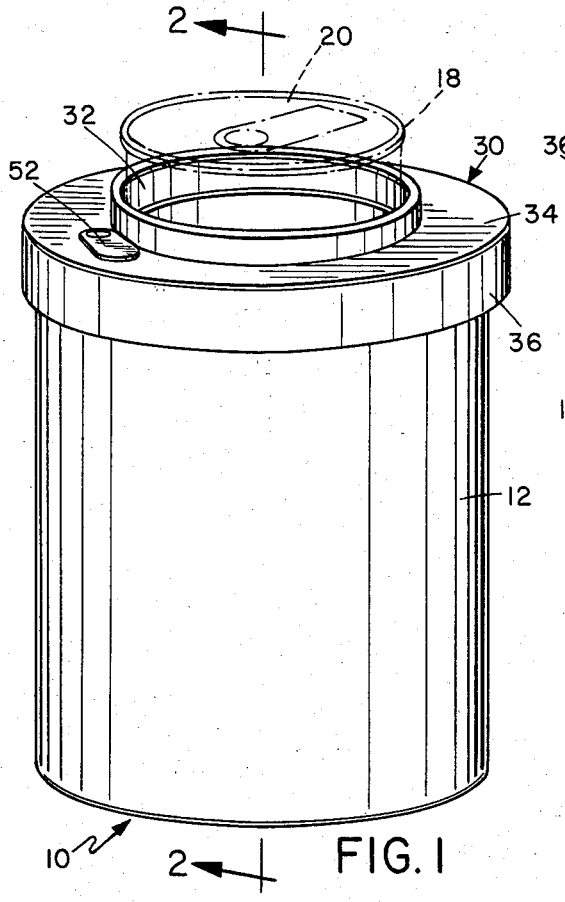
FIG. 1 is a perspective view of a beverage container cooler according to a preferred embodiment of the present invention, with a beverage can in the cooler illustrated in broken line.

The drawings show a single beverage container cooler according to a preferred embodiment of the present invention. Although the illustrated embodiment of the invention is designed for holding an aluminum beverage can of the type containing soft drinks or beer, the cooler may be designed to hold other types of beverage containers such as bottles or cardboard cartons of the type containing milk or fruit juice, by suitable alteration of the shape and dimensions of the inner container.

The beverage container cooler 10 basically comprises an outer container 12 which is preferably of a relatively good insulating material, and an inner container 14 co-axially mounted within the outer container so as to leave a spacing defining a coolant chamber 16 between the opposed inner and outer surfaces of the two containers for receiving ice or another suitable coolant material. such as "blue ice" or other non-toxic freezable liquids such as ethylene glycol. The outer and inner containers each have open upper ends.

As shown in the drawings, the inner container 14 is of cylindrical shape and is dimensioned to receive a typical beverage can 18 such that the upper end 20 of the can projects slightly out of the open end of the inner container 14. Thus the diameter of the inner container will be approximately equal to or slightly larger than the diameter of the typical beverage can, and the length of the inner container will be slightly less than that of the average beverage can. It will be understood that the inner container 14 could easily be shaped and dimensioned to receive other types and sizes of beverage containers such as bottles or cartons.

The inner container is shorter in length than the outer container, which is of corresponding cylindrical shape, so as to leave sufficient spacing between all of the opposed surfaces of the two containers for receiving coolant material such as cubes or chunks of ice. In the preferred embodiment of the invention the diameter of the outer container is at least 1.5 times the diameter of the inner container. In one example the diameter of the inner and outer containers were about 6.4 cm. and 10.2 cm., respectively, and their depths were of the order of 9.5 cm. and 11.5 cm, respectively. Thus the annular coolant chamber preferably has an annular width of at least 2 cm. and a depth at the base of the cooler also of at least 2 cm. The coolant chamber may be made larger if a longer cooling time is required, but this size chamber, when filled with ice, has been found to be adequate to keep a beverage can cool during a normal drinking period.

The outer container 12 is of solid mateial and its walls are preferably at least twice as thick as the walls of the inner container. The outer container has an internal rim or ledge 22 adjacent its upper open end. The inner container 14 has an annular flange 24 at its upper end which rests on the rim 22 when the inner container is placed into the outer container. The cylindrical body of the inner container has spaced longitudinal slots 26 around its periphery which extend along most of its length. Instead of the slots 26, other shapes of openings may be provided to provide communication between the coolant chamber and the interior of container 14. The slots or openings are small enough to prevent ice cubes or chunks in the coolant chamber from entering the inner container.

The annular flange 24 also has cut-outs or slots 28 around its periphery. The flange 24 may be in a spider-like form, with spoke-like projections from the open end of the inner container connected to the outer annular periphery of the flange. Ice may be added to the coolant chamber 16 by passing through the slots 28 or the ice may be added prior to insertion of the inner container 14.

The inner container is retained in the outer container by means of a locking cover or cap 30 which has a central opening 32, an annular flat portion 34, and a downwardly projecting cylindrical skirt 36 which fits around the upper end of the outer container as shown in FIG. 1.

Figure 2:
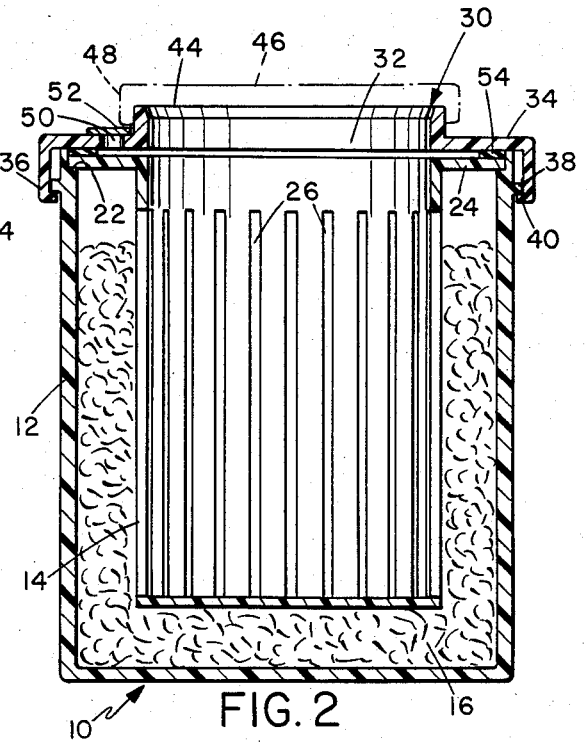
FIG. 2 is a sectional view taken on the lines 2—2 of FIG. 1.
Figure 3:
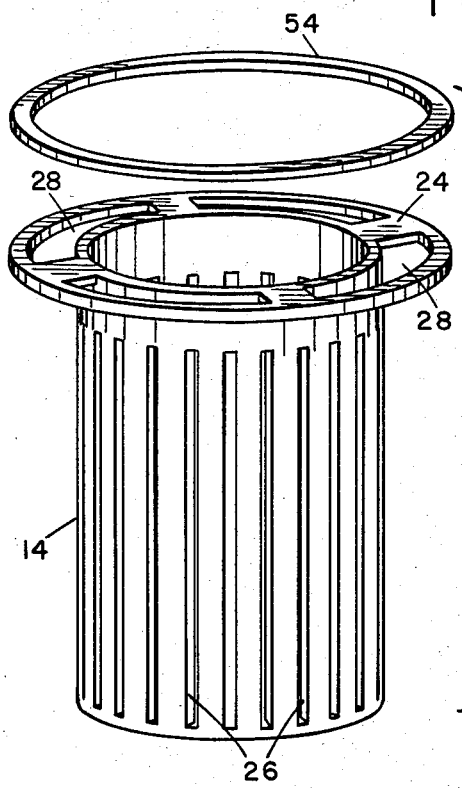
FIG. 3 is a perspective view of the removable inner container and sealing gasket.
Figure 4:
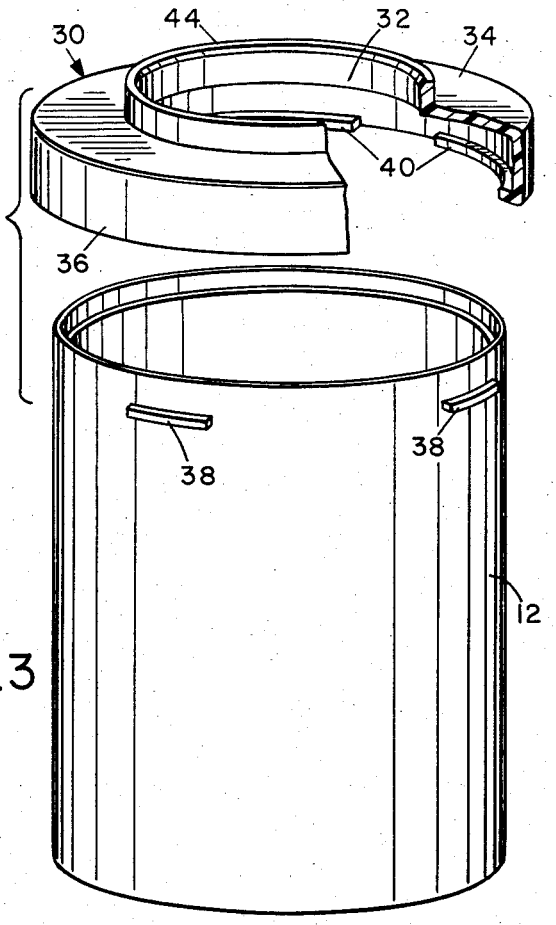
FIG. 4 is an exploded perspective view, partially cut away, of the outer container and locking cover.

The outer container has four symmetrically spaced locking projections 38 spaced around its periphery below the upper end of the container, and the skirt of the locking cap 30 has corresponding inwardly facing projections 40 as best seen in FIG. 4 which are designed to engage under the locking projections on the outer container as shown in FIG. 2 when the cap is placed over the container and rotated one quarter turn. Clearly a greater or lesser number of co-operating projections may be provided. The length of the projections 38 is equal to or less than the spacing between the projections 40, and the projections 40 are of length substantially equal to or less than the spacing between projections 38, to allow the cap to be placed on and removed from the outer container when the projections 38 are orientated into alignment with the spacings between the projections 40.

The cap also has an upwardly projecting rim 44 around its open end for receiving an optional cover 46 with a downturned lip 48 (see FIG. 2). The cover 46 can also be placed over the upper end 20 of a beverage can placed in the cooler to protect it from contamination after opening. A drain hole 50 with a slide cap 52 is provided in the annular portion of the locking cap 30. An annular sealing gasket 54 is provided between the flange 24 of the inner container and the annular portion of the locking cap.

Thus to assembly the parts of the cooler together the inner container is first inserted into the outer container, into which ice has previously been placed, until the flange 24 rests on the ledge 22. The sealing gasket 54, which may be of rubber, is then placed on top of the flange 24. The cap 30 is then placed over the upper end of the outer container, with its internal projections 40 aligned with the gaps between the outer locking projections 38 of the container 12, and then rotated one quarter turn so that the locking projections on the cap engage under the corresponding projections on the container to retain the cap in place.

A beverage can 18 may now be placed in the inner container as shown in FIG. 1. The upper end of the can will project out of the cooler so that a person can easily drink from it without removing it from the cooler, or remove the can from the cooler, take a drink and return it to the cooler, while the cooler stays in position, preferably on a flat surface, and can easily take it out of the cooler when empty. The ice 56 or blue ice or other coolant material in the coolant chamber 16 will keep the beverage in the can cool for a prolonged period of time and at least for as long as it takes the average person to finish drinking the contents of a single beverage can. The sealing gasket will help to prevent melted ice from leaking out of the container when tipped, while the drain hole in the locking cap and openings in the flange of the inner container will permit melted ice to be drained from the cooler without disassembling it. The cooler, when the chamber is filled with ice, is heavy and stable enough to reduce the risk of a beverage container being tipped over to spill its contents when the cooler is stood on the ground, for example. The parts of the cooler are readily separable both to add ice to the coolant chamber and for cleaning purposes.

The inner and outer containers are preferably of durable heavy duty plastics material, with the outer container walls preferably being at least twice the thickness of the inner container walls which are in the form of a mesh or open plan cage for improved cooling effects. The outer container may alternatively be of stainless steel when greater durability is desired.

Although the cooler has been described above for use with a single beverage container, alternative designs of the cooler according to the present invention may be provided for any beverage container which is to be kept cool and upright for an extended period of time after opening, for example bottles of beer, wine or soft drinks, and cartons of fruit juice or milk. In these alternatives the shape and dimensions of at least the inner container will be changed to conform with the shape and dimensions of the chosen type of beverage container. The outer container may be cylindrical or shaped to conform to the shape of the inner container.

Although a preferred embodiment of the present invention has been described above by way of example, it will be understood by those skilled in the field that modifications may be made to the disclosed embodiment without departing from the scope of the invention which is defined by the appended claims.

I claim:

1. A beverage container cooler, comprising:

an outer cylindrical container having an open upper end;

an inner cylindrical container having an open upper end and being coaxially mounted within the outer container with its base spaced above the bottom of the outer container, the inner container being dimensioned to receive a beverage container in a sleeve-like fashion;

the opposed inner and outer surfaces of the outer and inner container, respectively, defining a coolant chamber surrounding the cylindrical walls and base of the inner container for receiving a coolant material;

the inner container having a plurality of openings for communicating the coolant chamber with a beverage container in the inner container;

the outer container having an annular ledge around its upper end and the inner container having an annular flange around its upper end for resting on the ledge to hold the inner container in the outer container with its lower end spaced above the bottom of the outer container to allow coolant material in the coolant chamber to extend beneath the inner container;

the annular flange having a series of openings around its periphery for adding coolant material to the coolant chamber; and a locking cap for locking the inner container in the outer container, having an annular flange with a downwardly depending skirt for engaging over the open upper end of the outer container, the flange having a central opening for alignment with the opening in the inner container when the cap is engaged on the outer container, and releasable means for releasably locking the cap on the outer container, the flange further having a drain opening for draining material from the coolant chamber and a removable cover for normally covering the drain opening.

2. The cooler as claimed in claim 1, wherein the dimensions of the openings are smaller than the average size of a chunk of ice.

3. The cooler as claimed in claim 1, wherein the inner dimensions of the inner container are substantially equal to the outer dimensions of a typical single beverage can, the length of the inner container being slightly less than that of a can so that a can in the container projects upwardly slightly out of the open upper end.

4. The cooler as claimed in claim 1, wherein the spacing between the opposed surfaces of the outer and inner containers is at least 2 cm. all round.

5. The cooler as claimed in claim 1, wherein the diameter of the outer container is at least 1.5 times the diameter of the inner container.

6. The cooler as claimed in claim 1, wherein the inner container has a plurality of spaced longitudinal slots around its cylindrical periphery, the slots being narrower than the average ice chunk.

7. The cooler as claimed in claim 1, wherein the upper end portion of the outer container has a series of equally spaced first interlocking projections, and the lower end of the skirt has a corresponding number of spaced inwardly facing second interlocking projections, the length of the first interlocking projections being less than the spacing between the second interlocking projections and the length of the second interlocking projections being less than the spacing between the first interlocking projections, the second interlocking projections comprising means for engaging under the first interlocking projections when the locking cap is placed over the open upper end of the outer container and rotated on it a predetermined amount.

8. The cooler according to claim 1, wherein the locking cap has an upwardly projecting rim around the periphery of the central opening.

9. The cooler according to claim 8, further including a removable cover for covering the central opening of the locking cap.

10. The cooler according to claim 1, including an annular sealing gasket between the opposed annular faces of the locking cap and annular flange of the inner container.

* * * * *